United States Patent [19]

McKean

[11] Patent Number: 4,984,965

[45] Date of Patent: Jan. 15, 1991

[54] VARIABLE GEOMETRY TURBINE INLET WALL MOUNTING ASSEMBLY

[75] Inventor: Peter McKean, Marsh, United Kingdom

[73] Assignee: Holset Engineering Company Limited, United Kingdom

[21] Appl. No.: 352,094

[22] Filed: May 15, 1989

[30] Foreign Application Priority Data

May 17, 1988 [GB] United Kingdom ..... 8811621

[51] Int. Cl.[5] ..... F01B 25/02; F01D 17/12

[52] U.S. Cl. ..... 415/155; 415/156; 415/157; 415/165

[58] Field of Search ..... 415/148, 150, 151, 155, 415/156, 157, 165; 403/375; 285/61

[56] References Cited

U.S. PATENT DOCUMENTS

| | | | |
|---|---|---|---|
| 3,079,127 | 2/1963 | Rowlett et al. | 415/165 |
| 4,403,914 | 9/1983 | Rogo et al. | 415/165 |

FOREIGN PATENT DOCUMENTS

| | | | |
|---|---|---|---|
| 0095853 | 7/1983 | European Pat. Off. . | |
| 1913048 | 2/1970 | Fed. Rep. of Germany . | |
| 0131104 | 10/1979 | Japan | 415/157 |
| 8603809 | 7/1986 | PCT Int'l Appl. | 415/148 |

*Primary Examiner*—Edward K. Look
*Assistant Examiner*—Hoang Nguyen
*Attorney, Agent, or Firm*—Pravel, Gambrell, Hewitt, Kimball & Krieger

[57] ABSTRACT

A mounting assembly for a movable annular wall member of an inlet passageway of a variable geometry turbine. The inlet passageway is defined between the movable wall and a facing wall. The wall member is formed from a sheet material and is supported on a plurality of pins which extend parallel to the direction of movement of the wall member. The wall member comprises a tubular portion extending away from the facing wall and each pin supports a radial extending link. Each link is engaged in a respective slot in the tubular portion of the wall member, the links being a relatively close fit in the direction of movement of the wall member and a relatively loose fit in the circumferential direction.

4 Claims, 6 Drawing Sheets

VARIABLE GEOMETRY TURBINE INLET WALL MOUNTING ASSEMBLY

FIELD OF INVENTION

The present invention relates to a mounting assembly and in particular to a mounting assembly for a movable annular wall member of an inlet passageway of a variable geometry turbine.

DESCRIPTION OF THE PRIOR ART

Turbines generally comprise a turbine wheel mounted in a turbine chamber, an annular inlet passageway arranged around the turbine chamber, an inlet chamber arranged around the inlet passageway, and an outlet passageway extending from the turbine chamber. The passageways and chambers communicate such that pressurised gas admitted to the inlet chamber flows through the inlet passageway to the outlet passageway via the turbine chamber, thereby driving the turbine wheel. In a variable geometry turbine, one wall of the inlet passageway is defined by a movable annular wall member the position of which relative to a facing wall of the inlet passageway is adjustable to control the width of the inlet passageway.

One known variable geometry turbine arrangement is described in European Patent Specification EP-A-0080810. In the described arrangement a thin walled annular wall member is supported on a pair of guide pins which extend parallel to and are slidable parallel to the axis of rotation of the turbine wheel. Each pin is acted upon by a respective actuator. The pins are connected to the thin walled annular wall member in such a way that relative movement between the pins and the portions of the wall member to which they are connected is not possible.

The movable wall member is exposed to repeated rapid changes in temperature of large magnitude. As a result some thermal distortion of the wall member is inevitable. This distortion applies transverse forces to the support pins, increasing the probability of the support pins becoming jammed This is a major problem as doubts have been expressed as to the long term reliability of variable geometry turbines.

SUMMARY OF INVENTION

It is an object of the present invention to provide a mounting assembly for a movable annular wall member of a variable geometry turbine which obviates or mitigates the problems outlined above.

According to the present invention there is provided a mounting assembly for a movable annular wall member of an inlet passageway of a variable geometry turbine, wherein the inlet passageway is defined between the movable wall and a facing wall, the wall member is formed from a sheet material, and the wall member is supported on a plurality of pins which extend parallel to its direction of movement, characterised in that the wall member comprises a tubular portion extending away from the said facing wall, each pin supports a radially extending link, and each link is engaged in a respective slot in the tubular portion of the wall member, the links being a relatively close fit in the said direction of movement and a relatively loose fit in the circumferential direction.

Preferably each link defines a pair of spaced apart legs each of which is received in a respective slot in the tubular portion of the wall member. Each link may be in the form of a plate arranged perpendicular to the said direction of movement.

Preferably, the tubular portion of the wall member is terminated by a radially extending flange and the slots are defined in the tubular portion adjacent the flange.

BRIEF DESCRIPTION OF THE DRAWINGS

An embodiment of the present invention will now be described, by way of example, with reference to the accompanying drawings, in which.

DESCRIPTION OF THE PREFERRED EMBODIMENT

Figure 1:
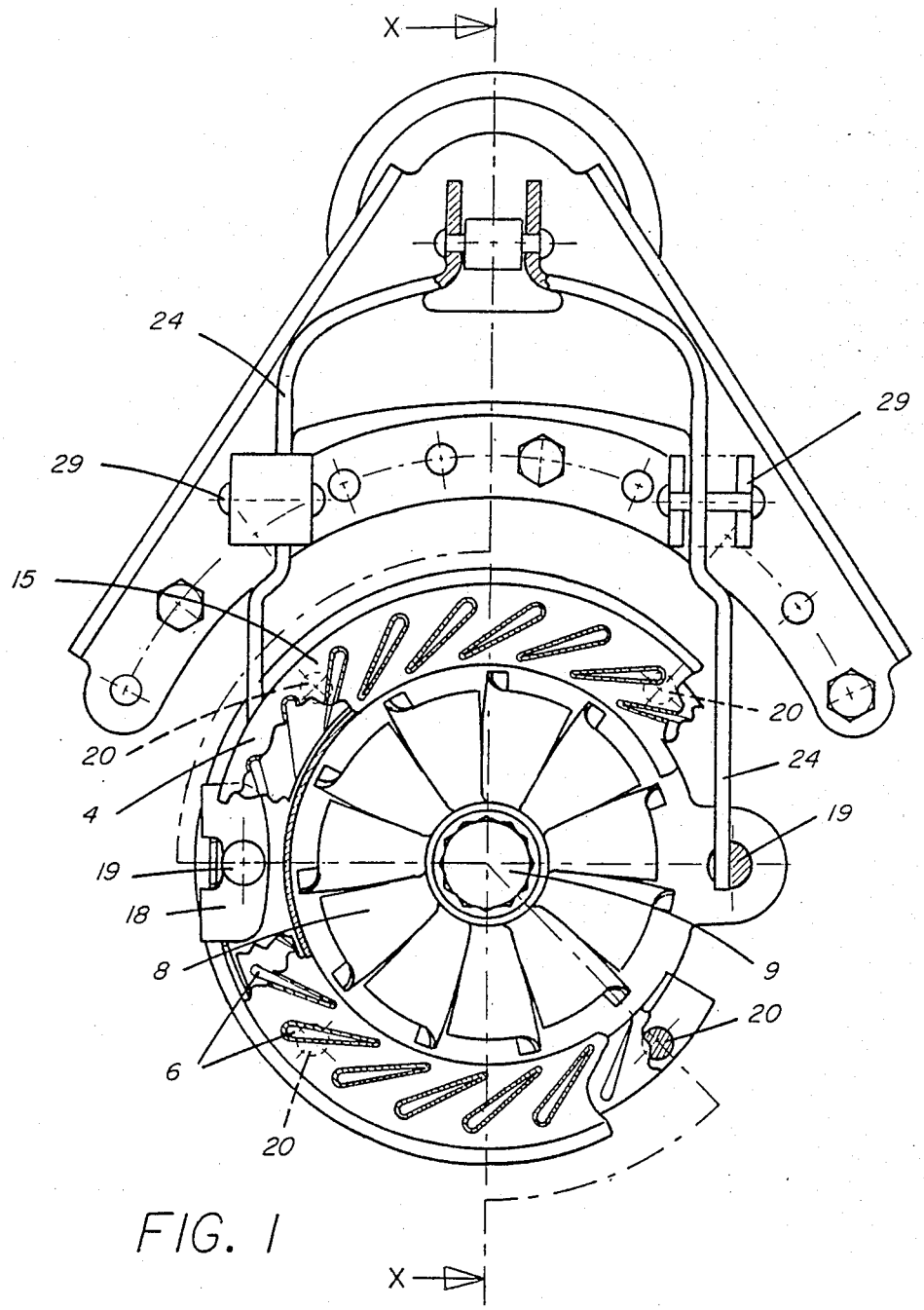
FIG. 1 is a cut-away view looking along the axis of a variable geometry turbine in accordance with the present invention, the view showing axially spaced features of the turbine.

Referring now to FIGS. 1 to 4, the illustrated variable geometry turbine comprises a turbine housing 1 defining a volute or inlet chamber 2 to which exhaust gas from an internal combustion engine (not shown) is delivered. The exhaust gas flows from the inlet chamber 2 to an outlet passageway 3 via an inlet passageway defined on one side by a movable annular member 4 and on the other side by a wall 5 which faces the movable annular wall member 4. An array of nozzle vanes 6 supported on a nozzle support ring 7 extends across the inlet passageway. Gas flowing from the inlet passageway 2 to the outlet passageway 3 passes over a turbine wheel 8 and as a result a torque is applied to a turbocharger shaft 9 which drives a compressor wheel 10. Rotation of the wheel 10 pressurises ambient air present in an air inlet 11 and delivers the pressurised air to an air outlet or volute 12. That pressurised air is fed to the internal combustion engine (not shown).

The movable annular wall member 4 is contacted by a sealing ring 13 and comprises a radially inner tubular wall 14, a radially extending annular portion 15 which defines slots through which the vanes 6 extend, a radially outer tubular portion 16 which bears against the sealing ring 13, and a radially extending flange 17. The radially outer tubular portion 16 is engaged by two diametrically opposed members 18 which are supported on respective guide pins 19.

The nozzle support 7 is mounted on an array of four guide pins 20 so as to be movable parallel to the axis of rotation of the turbocharger. Each of the guide pins 20 is biased by a compression spring 21 towards the right in FIGS. 2 to 4. Thus the nozzle support 7 and the vanes mounted on it are biased towards the right in FIGS. 2 to 4 and accordingly normally assume the position shown in FIG. 2, with the free ends of the vanes 6 bearing against the facing wall 5 of the inlet passageway.

Figure 2:
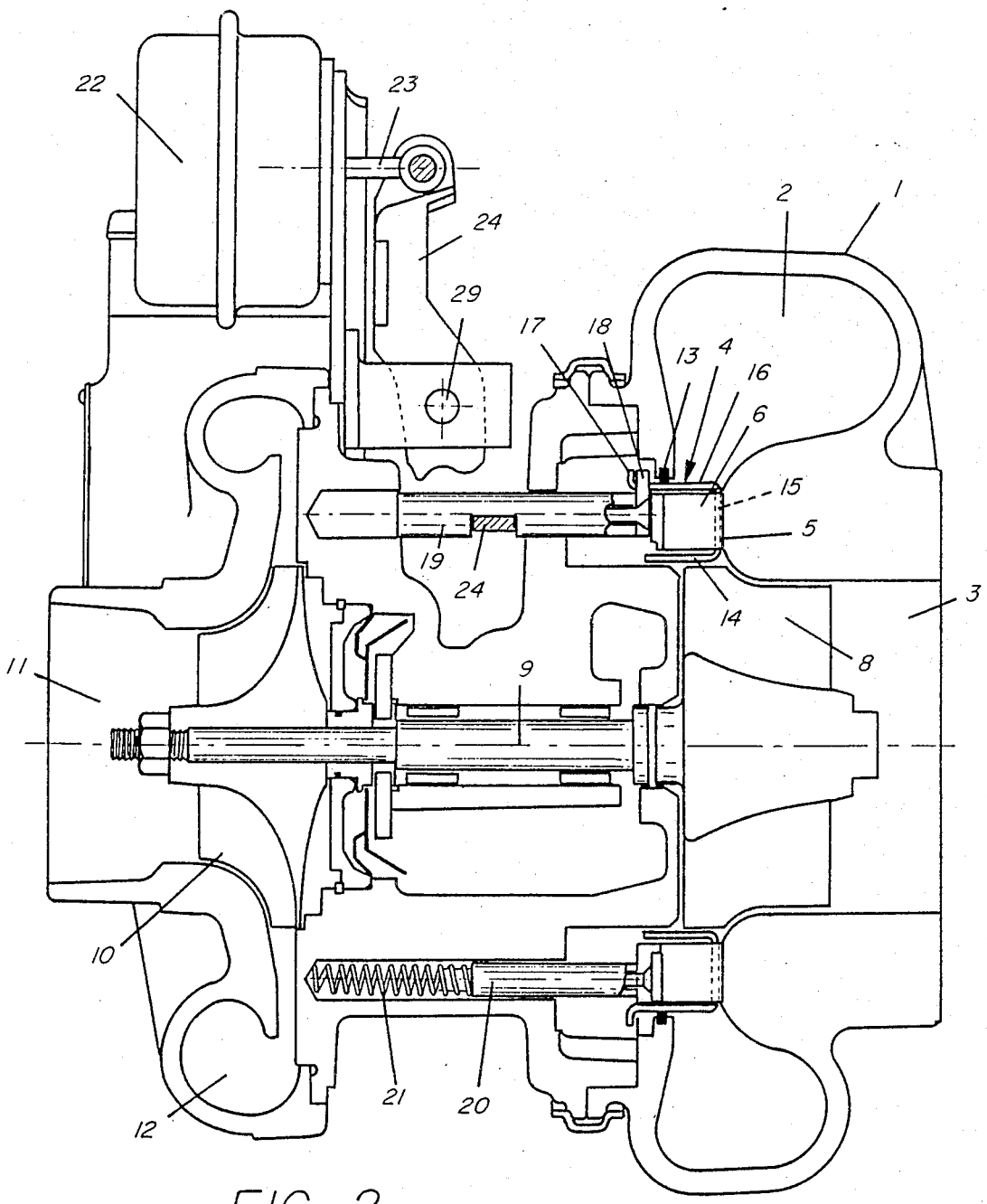
FIGS. 2, 3 and 4 are sectional views taken on the line X—X of FIG. 1 with components of the assembly of FIG. 1 shown respectively in the fully closed, half closed and fully open positions.
Figure 3:
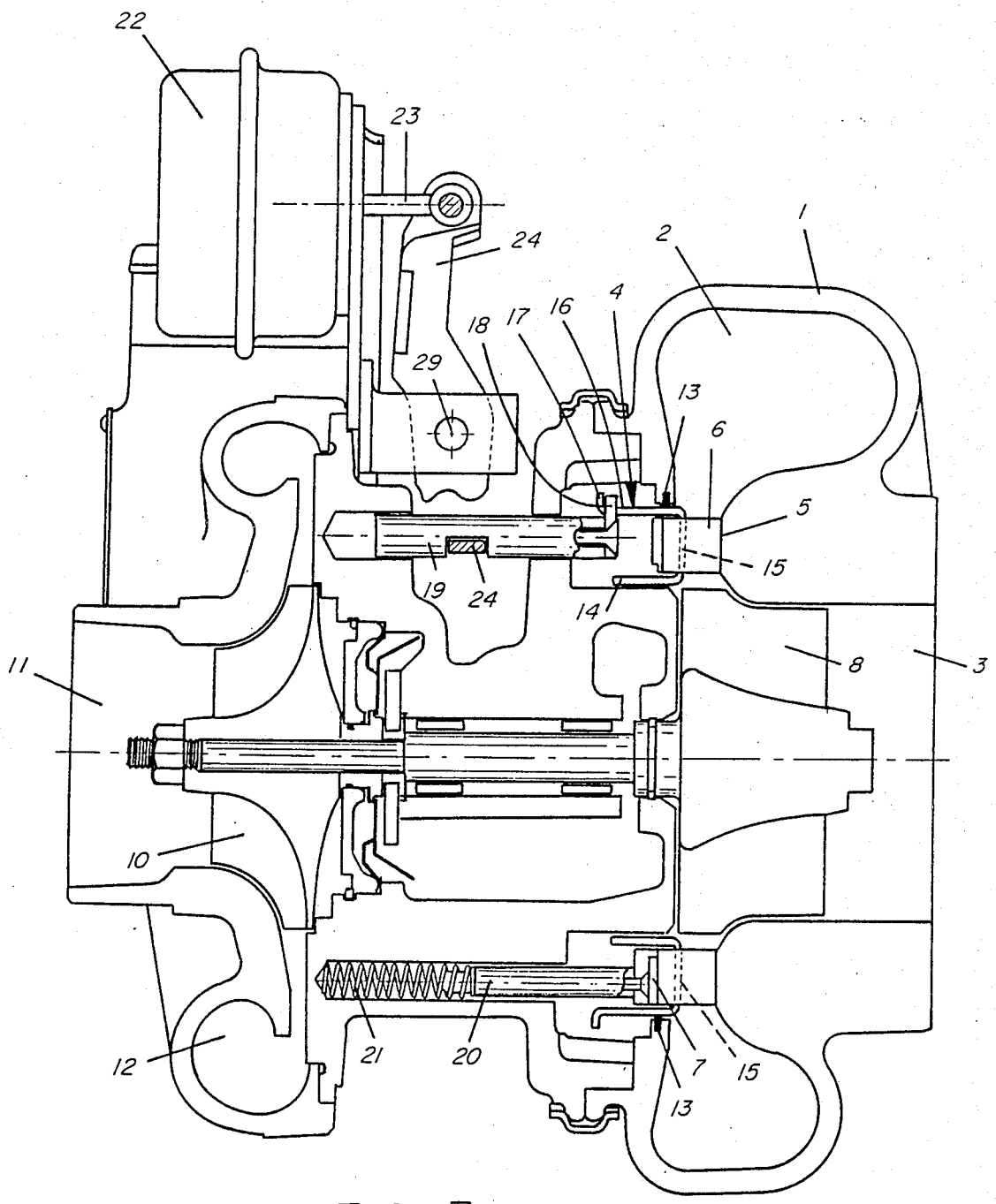
Figure 4:
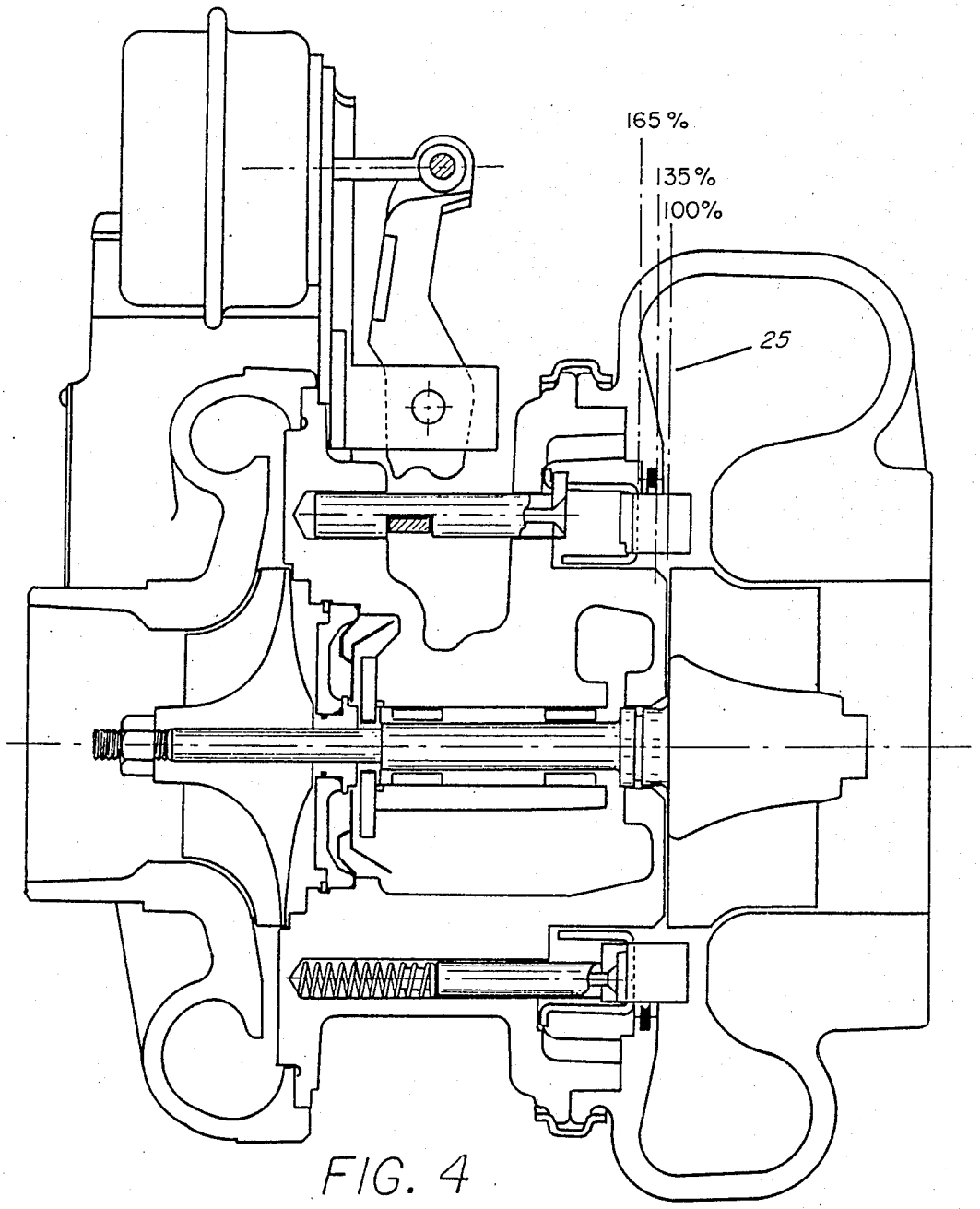

A pneumatically operated actuator 22 is operable to control the position of an output shaft 23 that is linked to a stirrup member 24 that engages each of the guide pins 19. Thus by controlling the actuator 22 the axial position of the guide pins 19 and thus of the movable annular wall member 4 can be controlled. FIG. 2 shows the movable annular wall member in its fully closed position in which the radially extending portion 15 of the member abuts the facing wall 5 of the inlet passageway FIG. 3 shows the annular wall member 4 in a half open position and FIG. 4 shows the annular wall member 4 in a fully open position. As the actuator 22 is positioned at a considerable distance from the turbine axis, space is not a problem. Furthermore, the precise radial position of the actuator shaft 23 is not critical, allowing tolerances to be increased. Equally radial expansion due to thermal distortion is not a critical problem.

Referring to FIG. 4, a dotted line 25 indicates an imaginary surface which is coplanar with the end surface of the turbine housing the downstream side of the movable member 4 and adjacent which the turbine wheel 8 is positioned. This surface in effect defines one side of the inlet passageway to the turbine chamber When the wall of the inlet passageway defined by the movable annular wall member 4 is aligned with the imaginary surface 25 the spacing between the annular wall member 4 and the facing wall 5 is for the purposes of the present description deemed to correspond to the inlet width of the inlet passageway downstream of the vanes 6.

This condition is referred to below as 100% of nominal inlet width When the movable annular wall member 4 is in the "100% of nominal inlet width" position the vanes 6 are still in contact with the facing wall 5. As the annular wall member 4 moves further away from the facing wall 5 the gap between the rear face of the annular wall member 4 and the nozzle support 7 is reduced until the two come into contact. This occurs when the spacing between the annular wall member and the facing surface 5 corresponds to 135% of the nominal inlet passageway inlet width. Further movement of the annular wall member 4 away from the facing wall 5 results in the nozzle support 7 moving with the annular wall member 4. Accordingly, the free ends of the vanes 6 are pulled back from the facing wall 5 and a gap therefore develops in the inlet passageway between the free ends of the vanes and the facing wall. This increases the effective area of the inlet passageway. When the annular wall member 4 is fully retracted (FIG. 4) its position corresponds to 165% of the nominal inlet passageway width.

Figure 5:
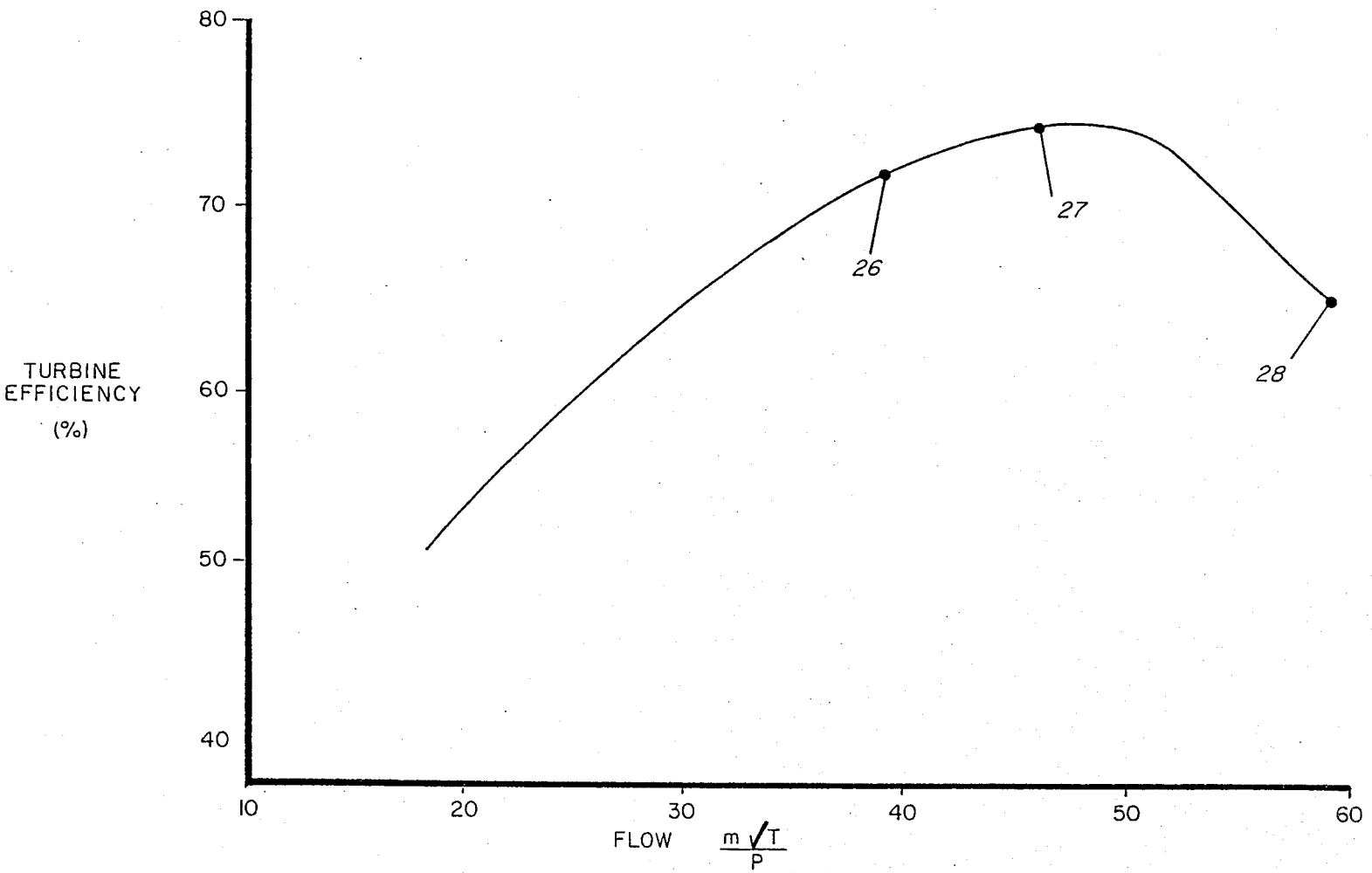
FIG. 5 is a representation of the relationship between turbine efficiency and mass flow through the turbine of FIG. 1, at a constant expansion ratio.

Referring now to FIG. 5, this illustrates the effect on turbine efficiency of movements of the annular wall member 4 and the nozzle support 7. The point on the curve corresponding to 100% of nominal inlet width is indicated by numeral 26. The points on the curve corresponding to 135% opening and 165% opening are indicated by numerals 27 and 28 respectively. Thus it can be seen that by providing for the annular wall member 4 to open well beyond the nominal 100% position and by providing for partial retraction at least of the nozzle vanes the operational characteristics of the turbine can be modified to increase the proportion of those operating characteristics which lie within a high efficiency region of the performance curve. Essentially, for a given flow range (corresponding to a fixed distance parallel to the flow axis) the ability to extend the characteristic curve to point 28 increases the mean turbine efficiency by avoiding operating the turbine in the less efficient region indicated by the left-hand end of the curve in FIG. 5.

Figure 6:
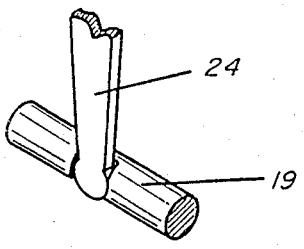
FIG. 6 illustrates the interrelationship between guide pins supporting a movable wall member of the arrangement of FIGS. 1 to 4 and a stirrup member which controls the position of those guide pins.

Referring now to FIG. 6, this shows the interengagement between the stirrup 24 and one of the guide pins 19 upon which the movable annular wall member 4 is mounted. The two ends of the stirrup 24 engage in slots cut in side surfaces of pins 19. The edges of the stirrup ends which bear against the ends of the slots are curved so that the clearance between each stirrup end and the slot ends is constant. The stirrup 24 is pivoted on pivot pins 29 so that the stirrup 24 forms a lever which can be moved to precisely position the pins 19. The stirrup 24 is formed from sheet steel arranged such that the stirrup is relatively stiff in the direction parallel to the axis of pins 19 but relatively flexible perpendicular to the pins. Thus transverse forces on the pins 19 are minimised, thereby reducing the probability of the pins 19 jamming in the bearings within which they slide. Furthermore, as the stirrup 24 engages central portions of the pins 19 the bearings in which the pins 19 are mounted are relatively widely spaced.

Figure 7:
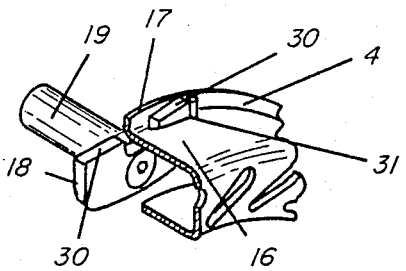
FIG. 7 illustrates the interrelationship between a guide pin of the type illustrated in FIG. 6 and a movable wall member.

FIG. 7 illustrates the interengagement between the guide pins 19 and the annular wall member 4. The member 4 is exposed to large variations in temperature and pressure and can accordingly distort to a certain degree. If the linkage between the member 4 and the pin 19 was rigid such distortion would apply significant transverse forces to the pins 19. Accordingly the engagement between the member 4 and 19 is such that distortion of the member 4 can be accommodated without applying transverse forces to the pin.

As shown in FIG. 7 this is achieved by rigidly mounting a bridge link plate 18 on the end of each pin 19. Two legs 30 of the bridge link engage in slots 31 defined in the tubular portion 16 of the member 4 adjacent the flange 17. The result is a structure which is adequately rigid in the direction of the axis of the pins 19 to ensure close control of the axial position of the member 4 but which is sufficiently loose in the radial and circumferential directions to accommodate thermal distortions of the member 4. The member 4 is in effect located on the vanes 6 and thus the member 4 is maintained in position despite its relatively loose mounting.

The bridge links 18 can be thicker than the flange 17 to maintain a stiff joint in the axial direction, and the width of the links 18 maintains a good resistance to tilting of the member 4 relative to the turbine axis.

Figure 8:
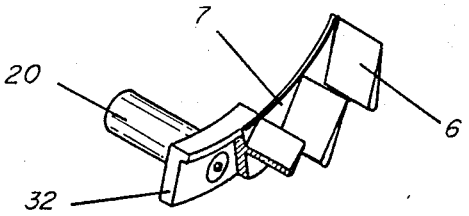
FIG. 8 illustrates the mounting of a nozzle vane support ring incorporated in the arrangement of FIGS. 1 to 4.

Referring now to FIG. 8, this illustrates the interrelationship between the spring biased support pins 20 and the nozzle support 7 on which the vanes 6 are mounted Each pin 20 has rigidly mounted on its end a bracket 32 which has a flat surface engaging the rear side of the nozzle support ring 7 and an inner edge which is flanged to engage inside the radially inner edge of the nozzle support ring 7.

The illustrated arrangement comprises a single annular seal 13 arranged around the radially outer side of the movable wall member 4. Alternative sealing arrangements are possible, however, for example a pair of seals arranged respectively on the radially inner and outer portions of the movable annular wall member 4.

I claim:

1. A mounting assembly for a movable annular wall member of an inlet passageway of a variable geometry turbine, wherein the inlet passageway is defined between the movable wall and a facing wall, the wall member is formed from a sheet material, and the wall member is supported on a plurality of pins which extend parallel to its direction of movement, characterised in that the wall member comprises a tubular portion extending away from the said facing wall, each pin supports a radially extending link, and each link is engaged in a respective slot in the tubular portion of the wall member, the links being a relatively close fit in the said direction of movement and a relatively loose fit in the circumferential direction.

2. A mounting assembly according to claim 1, wherein each link defines a pair of spaced apart legs each of which is received in a respective slot in the tubular portion of the wall member.

3. A mounting assembly according to claim 1 or 2, wherein each link is in the form of a plate arranged perpendicular to the said direction of movement.

4. A mounting assembly according to claim 1, wherein the tubular portion of the wall member is terminated by a radially extending flange and the slots are defined in the tubular portion adjacent the flange.

* * * * *